US011672309B2

(12) United States Patent
Tabor et al.

(10) Patent No.: US 11,672,309 B2
(45) Date of Patent: Jun. 13, 2023

(54) SINGLE HANDED SHOULDER STRAP LENGTH ADJUSTMENT

(71) Applicant: Levy's Leathers Ltd., Antigonish (CA)

(72) Inventors: Jennifer Tabor, Buchanan, MI (US); Rob Garofala, Lutz, FL (US); Kyle Narkiewicz, Tampa, FL (US)

(73) Assignee: LEVY'S LEATHERS LTD., Antigonish (CA)

( * ) Notice: Subject to any disclaimer, the term of this patent is extended or adjusted under 35 U.S.C. 154(b) by 196 days.

(21) Appl. No.: 16/928,110

(22) Filed: Jul. 14, 2020

(65) Prior Publication Data

US 2021/0015215 A1 Jan. 21, 2021

Related U.S. Application Data

(60) Provisional application No. 62/874,526, filed on Jul. 16, 2019.

(51) Int. Cl.
*A44B 11/04* (2006.01)
*A41F 15/00* (2006.01)

(52) U.S. Cl.
CPC ..... *A44B 11/04* (2013.01); *A41F 15/002* (2013.01)

(58) Field of Classification Search
CPC ..... A44B 11/04; A41F 15/002; Y10T 24/4093
See application file for complete search history.

(56) References Cited

U.S. PATENT DOCUMENTS

| | | | | | |
|---|---|---|---|---|---|
| 685,831 | A * | 11/1901 | Frawley | F16L 33/02 | 24/200 |
| 1,675,040 | A * | 6/1928 | Mix | A44B 11/04 | 24/198 |
| 2,066,914 | A * | 1/1937 | Staples | A44B 11/04 | 24/200 |
| 4,630,763 | A * | 12/1986 | Friedman | G10G 5/005 | 224/640 |
| 6,629,628 | B1 * | 10/2003 | Canepari | A45C 13/30 | 150/112 |
| D885,254 | S * | 5/2020 | Jiang | D11/218 | |
| 2004/0093700 | A1 * | 5/2004 | Frangesh | A44B 11/04 | 24/169 |
| 2008/0078069 | A1 * | 4/2008 | Pontaoe | A44B 11/266 | 24/200 |
| 2010/0170065 | A1 * | 7/2010 | Paik | A44B 11/04 | 24/163 R |
| 2011/0186606 | A1 * | 8/2011 | Apthorp | G10G 5/005 | 224/257 |
| 2018/0255881 | A1 * | 9/2018 | Sorensen | A44B 11/065 | |
| 2018/0317611 | A1 * | 11/2018 | Rittenhouse | A44B 11/04 | |
| 2019/0005930 | A1 * | 1/2019 | Nannen | G10G 5/005 | |
| 2019/0025013 | A1 * | 1/2019 | Lance | F41C 33/002 | |
| 2019/0111887 | A1 * | 4/2019 | Kukielka | B60R 22/024 | |
| 2020/0248983 | A1 * | 8/2020 | Bergman | F41C 23/02 | |

* cited by examiner

*Primary Examiner* — Robert Sandy
*Assistant Examiner* — Rowland Do
(74) *Attorney, Agent, or Firm* — Taft Stettinius & Hollister LLP; Derek Lavender

(57) ABSTRACT

A shoulder strap system having a shoulder strap attached to a device for supporting or carrying the device on a person's shoulder. The system has a tri-glide slide and a pull attached to the tri-glide slide. A length of the should strap is adjustable by the person pulling on the pull by one hand in either an upward or downward direction, thereby allowing the length to be adjusted without requiring the person to unsling the strap.

12 Claims, 4 Drawing Sheets

SINGLE HANDED SHOULDER STRAP LENGTH ADJUSTMENT

CROSS-REFERENCE TO RELATED APPLICATIONS

This application claims the benefit of U.S. Provisional Application Ser. No. 62/874,526, filed Jul. 16, 2019, the entirety of which is incorporated herein by reference.

FIELD OF THE INVENTION

The invention relates to shoulder straps, slings, carrying straps and the like. More particularly, the invention pertains to a new shoulder strap system that permits single-handed length adjustment of the strap.

BACKGROUND OF THE INVENTION

Shoulder straps or the like are attached to various articles for carrying the articles upon an individual's shoulder. For example, a guitar strap is attached at opposite ends to opposite ends of a guitar and the strap is slung around and across the individual's shoulder to support the guitar on the shoulder by the strap. The strap length must be adjusted so that the guitar is at the correct height on the individual. Conventionally, a tri-glide slide is attached to the strap and allows adjusting the strap length by sliding the slide along the strap in either direction. Sliding the slide in one direction lengthens the strap and sliding the slide in the opposite direction shortens the strap.

While conventional tri-glide slides or the like meet the purpose of adjusting the length of straps they have disadvantages. For example, an individual must use two hands in order to move the slide along the strap to adjust the strap's length. That is, one hand is need to grasp the slide and the other hand to grasp the strap. Such a two-handed operation is undesirable because an individual may not have the ability to use both hands or both hands may not be free when the strap length needs adjustment. Accordingly, there is a need and a desire for the ability to adjust the length of a shoulder strap or the like by using only one hand.

SUMMARY OF THE INVENTION

Embodiments of the invention provide shoulder strap having a one-handed adjustment system that allows adjusting the length of the strap using only one hand.

In one aspect, a one-handed adjustment system includes a tri-glide slide having a pull attached to the center bar, upon which a user may pull on with one hand and slide the tri-guide to lengthen or shorten the strap as desired.

In another aspect, a one-handed adjustment system includes a tri-glide slide having a pull attached to pull bar that is located above the center bar, upon which a user may pull on with one hand and slide the tri-guide to lengthen or shorten the strap as desired.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
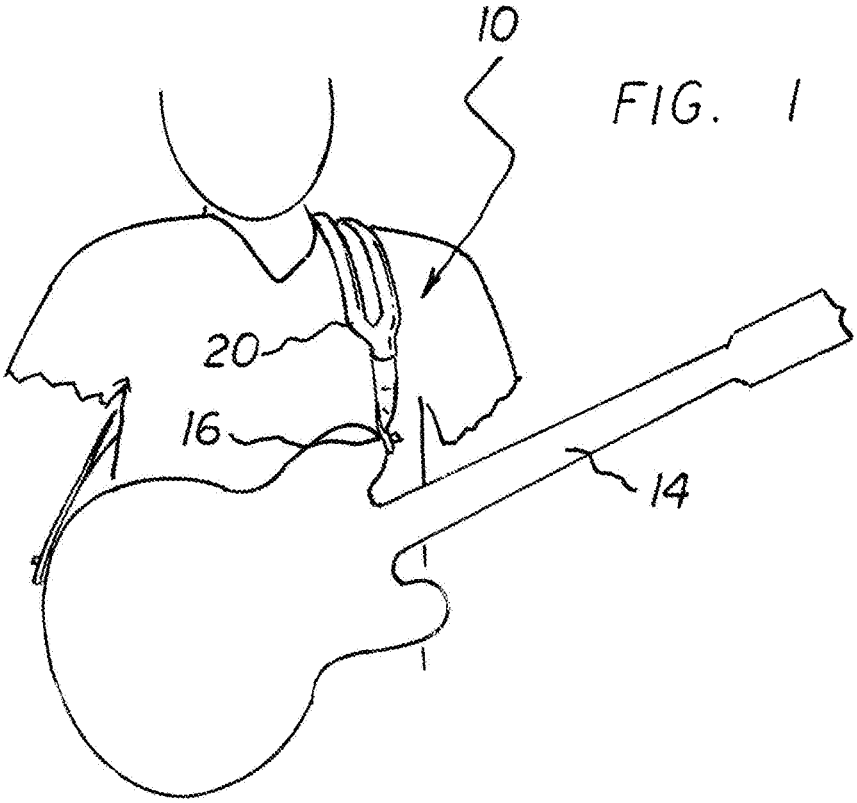
FIG. 1 is a front diagrammatic view of a shoulder strap system constructed in accordance with an embodiment of the invention, shown in-use in connection with a guitar and individual.

Initially, with reference to FIGS. 1 through 7 of the drawings, reference number 10 generally designates a shoulder strap having a one-handed adjustment system 12 that is constructed in accordance with an embodiment of the invention. As depicted, the shoulder strap 10 is a guitar strap and is shown in-use with a guitar 14. However, it should be noted, the invention is not limited to the illustrated guitar strap and may be used with any strap or sling that needs length adjustment and, therefore, should not be limited in any way to only a guitar strap.

Figure 2:
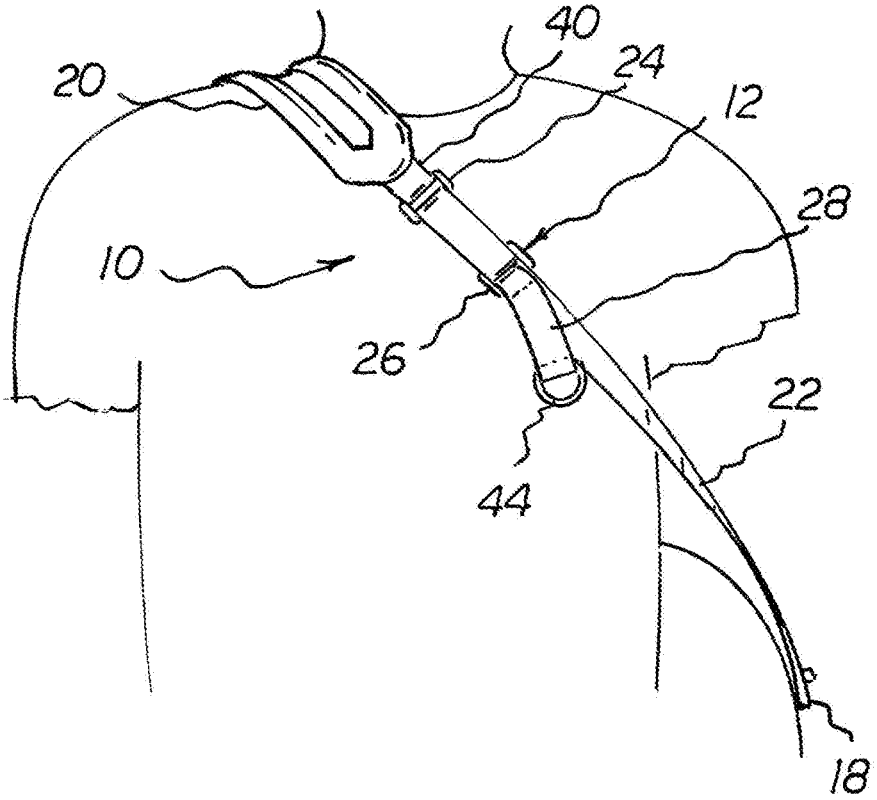
FIG. 2 is a front diagrammatic view of a shoulder strap system constructed in accordance with an embodiment of the invention, shown in-use in connection with a guitar and individual.

As depicted, one end 16 of the strap 10 is attached to one end of the guitar 14 and the other end 18 of the strap is attached to the other end of the guitar with the strap slung over the individual's shoulder (as seen in FIGS. 1 and 2). The strap 10 has two sections 20 and 22, a ring 24, and the one-handed adjustment system 12. The one-handed adjustment system 12 includes a tri-glide slide 26 and a pull 28. The slide 26 includes opposite end bars 30 and 32 and a center bar 34. The pull 28 is attached at end 36 thereof to the center bar 34 and terminates at an opposite, free end 38 that may have a pull handle or ring 44 attached therewith.

Figure 7:
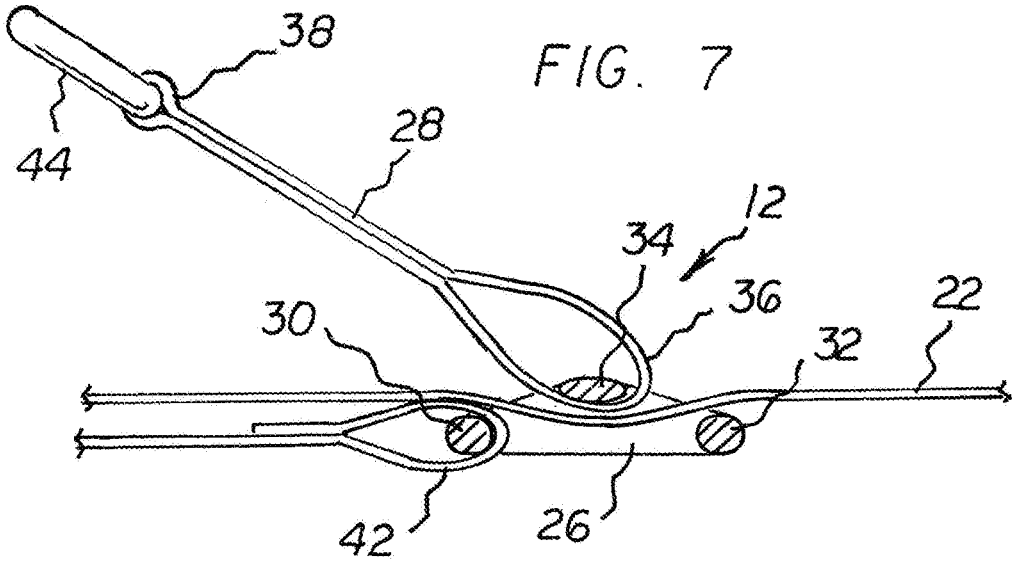
FIG. 7 is a side, cross-sectional view through a one-handed adjustment system constructed in accordance with an embodiment of the invention.

Section 20 of the strap 10 is attached at end 16 to the guitar 14 and the other end 40 is attached to the ring 24. Section 22 of the strap is attached at end 18 to the guitar 14 with the opposite end 42 threaded through ring 24 and then attached to end bar 30 of the slide 26. A length of strap section 22 is also threaded through the slide 26, under the center bar 34 and over the end bars 30 and 32 as best seen in FIG. 7.

Figure 5:
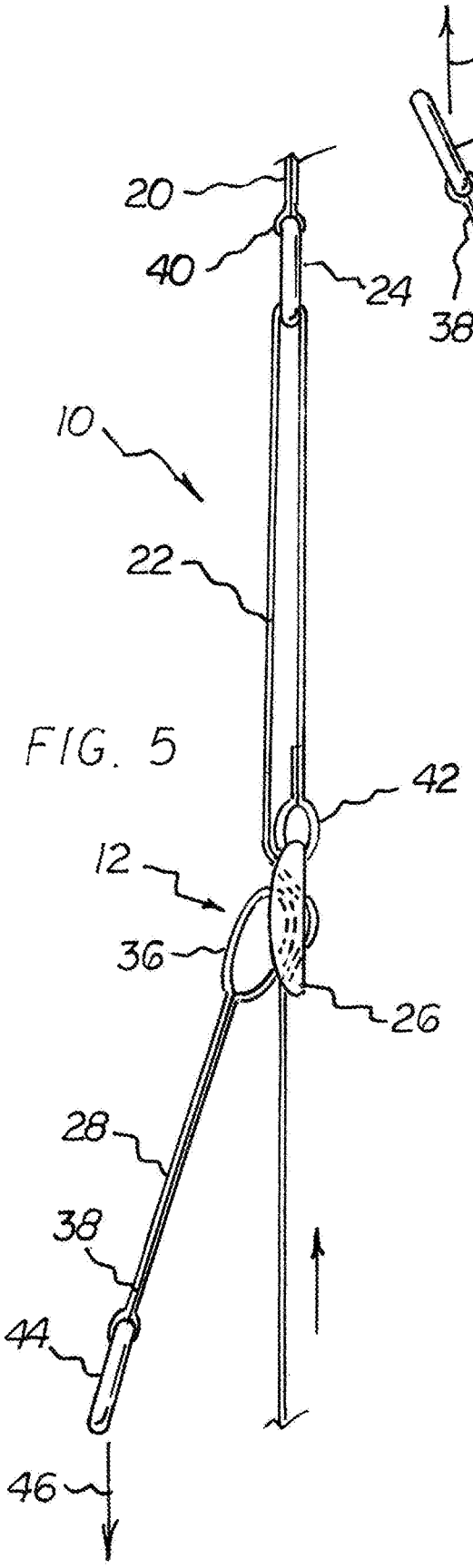
FIG. 5 is a side view of a shoulder strap system constructed in accordance with an embodiment of the invention, illustrating the strap being shortened.
Figure 6:
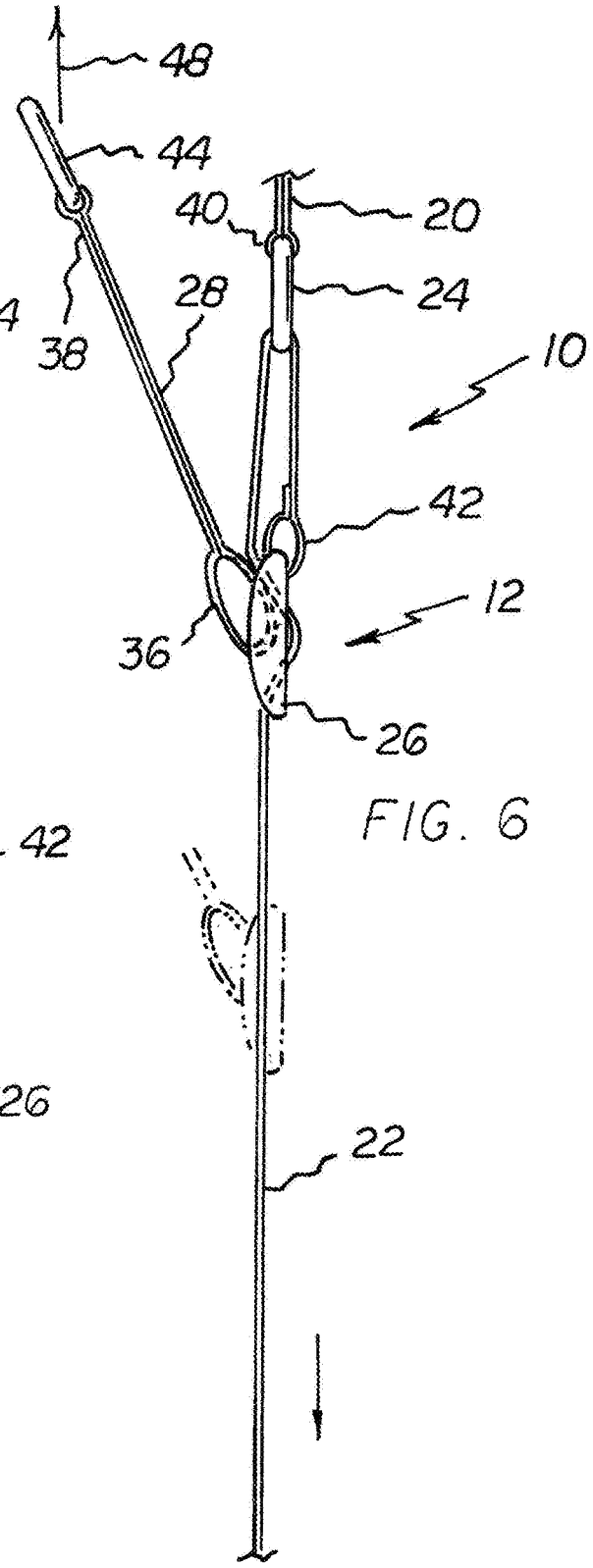
FIG. 6 is a side view of a shoulder strap system constructed in accordance with an embodiment of the invention, illustrating the strap being lengthened.

With reference to FIGS. 5 and 6, with the strap 10 slung across a shoulder (not shown for clarity), the length of strap 10 can be adjusted by grasping the pull 28 with one hand and pulling the pull in direction toward the ring 24 or in a direction away from the ring. Particularly, pulling the pull 28 in a direction 46 away from the ring 24 causes the slide 26 to move in the same direction to shorten the strap 10. And pulling the pull 28 in a direction 48 toward the ring 24 causes the slide 26 to move in the same direction and lengthen the strap 10.

Figure 8:
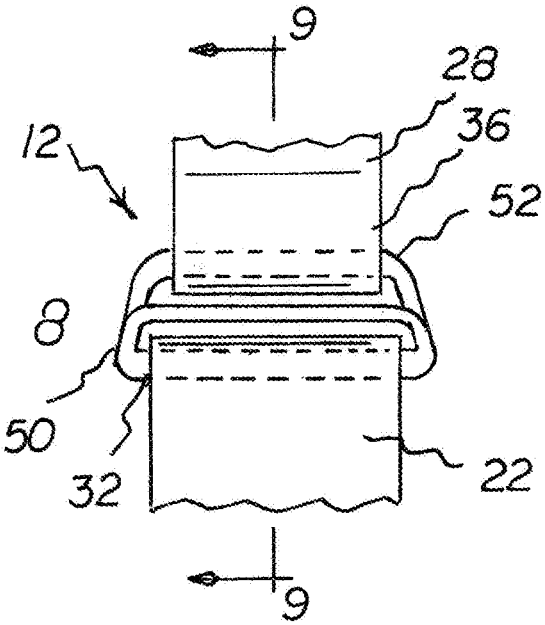
FIG. 8 is an end view of an alternative embodiment of a one-handed adjustment system constructed in accordance with an embodiment of the invention.
Figure 9:
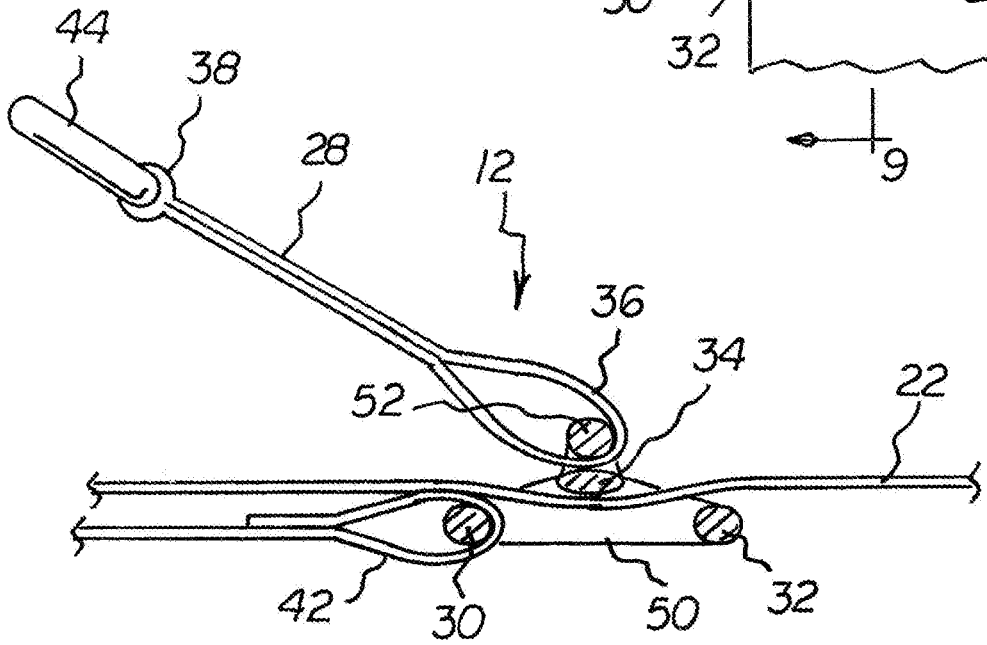
FIG. 9 is a side, cross-sectional view taken along line 9-9 in FIG. 8.

Turning to FIGS. 8 and 9, an alternative embodiment of slide 26 is shown and designated by reference number 50. Like slide 26, slide 50 includes the opposite end bars 30 and 32 and a center bar 34, but also includes a pull bar 52 that is disposed in a spaced relation to center bar 34 at an outward location thereof. In this embodiment, the pull 28 is not attached to the center bar 34, but, rather, is attached to the pull bar 52. The configuration of slide 50 may be desirable over the configuration of slide 26 when friction between the pull 28 and the strap section 22 is not wanted. Configuration of slide 50 eliminates friction between the pull 28 and strap section 22 by disposing the pull away from the strap section to prevent surface contact therebetween.

Figure 3:
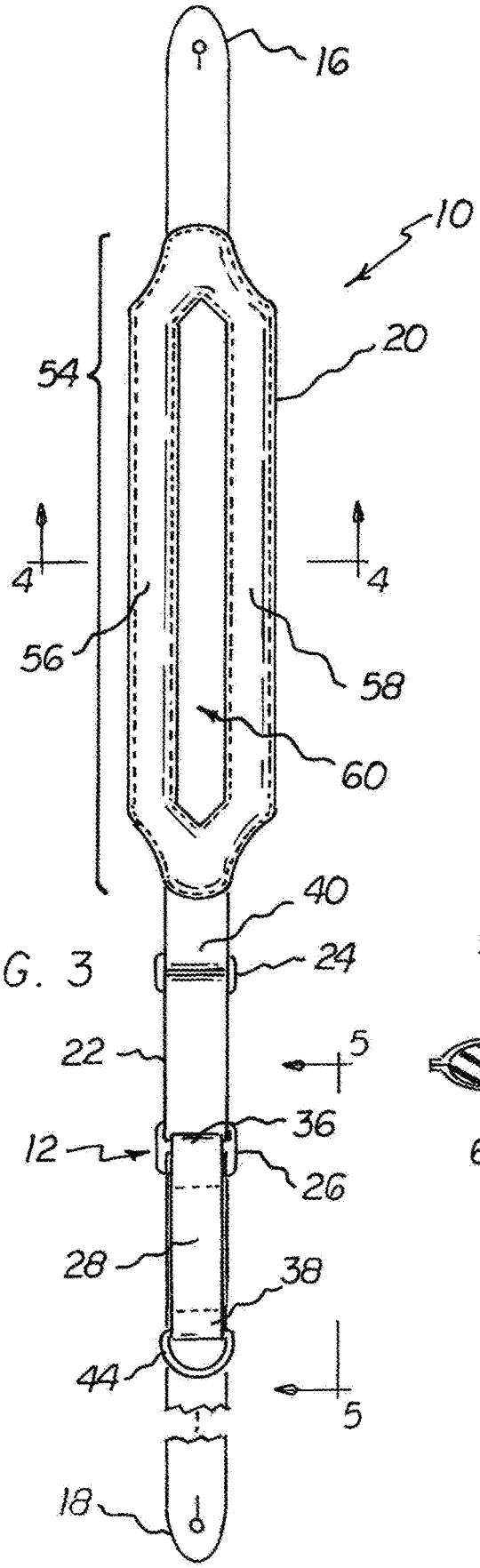
FIG. 3 is a front view of a shoulder strap system constructed in accordance with an embodiment of the invention.
Figure 4:
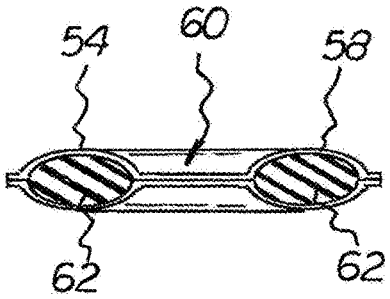
FIG. 4 is a cross-sectional view taken along line 4-4 in FIG. 3.

With reference to FIGS. 3 and 4, in embodiments, strap 10 may include a split construction that operates to reduce or eliminate pressure on an individual's shoulder when the strap is slung thereupon. Particularly, section 20 has a length 54 that is bifurcated into two branches 56 and 58 that are joined at opposite ends and a centrally disposed opening 60 between the branches. This construction allows the strap along length 54 to flex and conform to the individual's shoulder, thereby relieving pressure points that are otherwise present with conventional, unsplit straps. Further, as depicted, branches 56 and 58 may be padded with padding 62 to further increase comfort and relieve pressure points.

While the invention has been particularly shown and described with respect to the illustrated embodiments thereof, it will be understood by those skilled in the art that the foregoing and other changes in form and details may be made therein without departing from the spirit and scope of the invention.

What is claimed is:

1. A shoulder strap system for adjusting the length of a shoulder strap using a single hand, the shoulder strap system comprising:

a tri-glide slide having a pair of side members spaced apart from one another, first and second end bars each attached to and extending between the side members at opposite ends thereof, and a center bar attached to and extending between the side members at a position between the end bars;

a pull attached at a first end to the center bar and terminating at an opposite, free second end;

a shoulder strap, the shoulder strap having a first strap section of a length of strap and a second strap section of a length of strap, the first strap section having opposite first and second ends, the second strap section having opposite third and fourth ends;

a ring attached to the first end of the first strap section and the second end of the first strap section adapted to attach to a device to be carried by a user;

the third end of the second strap section being looped through the ring and secured to the first end bar, the second strap section being threaded through the tri-glide slide such the first and second end bars are disposed along a first broad face of the second strap section and the center bar is disposed along a second broad face of the second strap section which is opposite the first broad face the second strap section; and the fourth end of the second strap section adapted to be attach to the device;

wherein a length of the shoulder strap, as measured between the second end of the first strap section and the fourth end of the second strap section, is adjustable by pulling on the pull in a direction either toward the second end or the fourth end to move the tri-glide slide in the same direction; and wherein a friction between the first end of the pull and the first face of the second strap section prevents the tri-glide slide from moving without pulling on the pull; and wherein the first end of the pull wraps around the center bar.

2. The shoulder strap system of claim 1, wherein the first strap section has a length thereof that is bifurcated.

3. The shoulder strap system of claim 1, wherein the pair of side members are disposed substantially parallel to one another.

4. The shoulder strap system of claim 1, further comprising:

a pull handle attached to the second end of the pull.

5. A shoulder strap system for adjusting the length of a shoulder strap, the shoulder strap system comprising:

a tri-glide slide having a pair of side members spaced apart from one another, first and second end bars each attached to and extending between the side members at opposite ends thereof, a center bar attached to and extending between the side members at a position between the end bars, a pull bar spaced from the center bar in a outwardly direction thereof;

a pull attached at a first end thereof to the pull bar and terminating at an opposite, free second end;

a shoulder strap, the shoulder strap having a first strap section of a length of strap and a second strap section of a length of strap, the first strap section having opposite first and second ends, the second strap section having opposite third and fourth ends;

a ring attached to the first end of the first strap section and the second end of the first strap section adapted to attach to a device to be carried by a user;

the third end of the second strap section being looped through the ring and secured to the first end bar, the second strap section being threaded through the tri-glide slide such the first and second end bars are disposed along a first broad face of the second strap section and the center bar is disposed along a second broad face of the second strap section which is opposite the first broad face the second strap section; and the fourth end of the second strap section adapted to be attach to the device;

wherein a length of the shoulder strap, as measured between the second end of the first strap section and the fourth end of the second strap section, is adjustable by pulling on the pull in a direction either toward the second end or the fourth end to move the tri-glide slide in the same direction wherein the first end of the pull wraps around the pull bar.

6. The shoulder strap system of claim 5, wherein the first strap section has a length thereof that is bifurcated.

7. The shoulder strap system of claim 5, wherein the pair of side members are disposed substantially parallel to one another.

8. The shoulder strap system of claim 5, further comprising: a pull handle attached to the second end of the pull.

9. A shoulder strap system for adjusting the length of a shoulder strap using a single hand, the shoulder strap system comprising:

a tri-glide slide having an outward side, an inward side, a pair of longitudinally extending side members that are spaced apart from one another, first and second end bars each attached to and extending between the side members at opposite ends thereof, a center bar attached to and extending between the side members at a position between the end bars, a pull bar spaced from the center bar in a outwardly direction thereof;

a pull attached at a first end thereof to the pull bar and terminating at an opposite, free second end;

a shoulder strap, the shoulder strap having a first strap section of a length of strap and a second strap section of a length of strap, the first strap section having opposite first and second ends, the second strap section having opposite third and fourth ends;

a ring attached to the first end of the first strap section and the second end of the first strap section adapted to attach to a device to be carried by a user;

the third end of the second strap section being looped through the ring and secured to the first end bar, the second strap section being threaded through the tri-glide slide such the first and second end bars are disposed along a first broad face of the second strap section and the center bar is disposed along a second broad face of the second strap section which is opposite the first broad face the second strap section;

the fourth end of the second strap section adapted to be attach to the device; and wherein a length of the shoulder strap, as measured between the second end of the first strap section and the fourth end of the second strap section, is adjustable by pulling on the pull in a direction either toward the second end or the fourth end to move the tri-glide slide in the same direction.

10. The shoulder strap system of claim 9, wherein the first strap section has a length thereof that is bifurcated.

11. The shoulder strap system of claim 9, wherein the pair of side members are disposed substantially parallel to one another.

12. The shoulder strap system of claim 9, further comprising:

a pull handle attached to the second end of the pull.

* * * * *